United States Patent [19]

Reid

[11] Patent Number: 4,840,720

[45] Date of Patent: Jun. 20, 1989

[54] PROCESS FOR MINIMIZING FOULING OF PROCESSING EQUIPMENT

[75] Inventor: Dwight K. Reid, Houston, Tex.

[73] Assignee: Betz Laboratories, Inc., Trevose, Pa.

[21] Appl. No.: 240,775

[22] Filed: Sep. 2, 1988

[51] Int. Cl.[4] ..... C10G 9/16

[52] U.S. Cl. ..... 208/48 AA; 208/47; 208/48 R; 208/255; 585/950; 252/389.24; 252/400.24

[58] Field of Search ..... 208/48 AA, 255, 48 R; 585/950, 648; 252/389.24, 400.24; 584/650

[56] References Cited

U.S. PATENT DOCUMENTS

| | | | |
|---|---|---|---|
| 3,645,886 | 2/1972 | Gillespie et al. | 208/48 AA |
| 3,647,677 | 3/1972 | Wolff et al. | 208/48 |
| 4,024,048 | 5/1977 | Shell et al. | 208/48 AA |
| 4,024,049 | 5/1977 | Shell et al. | 208/48 AA |
| 4,024,050 | 5/1977 | Shell et al. | 208/48 AA |
| 4,024,051 | 5/1977 | Shell et al. | 208/348 |
| 4,226,700 | 10/1980 | Broom | 208/48 AA |
| 4,425,223 | 1/1984 | Miller | 208/48 AA |
| 4,440,625 | 4/1984 | Go et al. | 208/48 AA |
| 4,456,526 | 6/1984 | Miller et al. | 208/48 AA |
| 4,509,952 | 4/1985 | Braxton, Jr. | 44/57 |
| 4,551,226 | 11/1985 | Fern | 585/950 |

FOREIGN PATENT DOCUMENTS 2157670 10/1985 United Kingdom .

*Primary Examiner*—H. M. S. Sneed
*Assistant Examiner*—Helane Myers
*Attorney, Agent, or Firm*—Alexander D. Ricci; Steven D. Boyd

[57] ABSTRACT

This invention relates to processes for inhibiting the degradation, particulate and gum formation of distillate fuel oils prior to or during processing which comprises adding to the distillate fuel oil an effective inhibiting amount of a mixture of (a) a phosphite compound having the formula

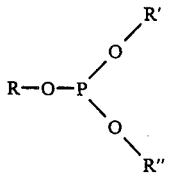

wherein R, R′ and R″ are the same or different and are alkyl, aryl, alkaryl or aralkyl groups, and (b) an effective amount of hydroxylamine, having the formula.

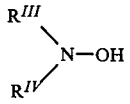

wherein $R^{III}$ and $R^{IV}$ are the same or different and are hydrogen, alkyl, aryl, alkaryl or aralkyl groups, wherein the weight ratio of (a):(b) is from about 1:10 to about 10:1.

21 Claims, No Drawings

PROCESS FOR MINIMIZING FOULING OF PROCESSING EQUIPMENT

BACKGROUND OF THE INVENTION

1. Field of the Invention

This invention relates to a process for inhibiting or preventing fouling in refinery and petrochemical feedstocks during processing. More particularly, this invention relates to inhibiting distillate fuel fouling, manifested by particulate formation and gum generation in distillate fuel oils.

2. Description of the Prior Art

During hydrocarbon processing, transportation and storage, the hydrocarbons deteriorate, particularly when subjected to elevated temperatures. The deterioration usually results in the formation of sediment, sludge or gum and can manifest itself visibly by color deterioration. Sediment, sludge or gum formation may cause clogging of equipment or fouling of processing equipment (such as heat exchangers, compressors, furnaces, reactors and distillation systems, as examples). The fouling can be caused by the gradual accumulation of high molecular weight polymeric material on the inside surfaces of the equipment. As fouling continues, the efficiency of the operation associated with hydrocarbon processing equipment such as heat exchangers, compressors, furnaces, reactors and distillation systems decreases. The distillate streams which can result in significant fouling include the straight-run distillates (kerosene, diesel, jet), naphthas, lube oils, catalytic cracker feedstocks (gas oils), light and heavy cycle oils, coker naphthas, resids and petrochemical plant feedstocks.

The precursors leading to the formation of the foulants may form in tankage prior to hydrocarbon processing. Unstable components may include such species as oxidized hydrocarbons (for example, aldehydes and ketones), various organosulfur compounds, olefinic hydrocarbons, various inorganic salts and corrosion products.

Suggestions of the prior art for inhibiting the fouling rate in process heat transfer equipment include U.S. Pat. No. 3,647,677, Wolff et al., which discloses the use of a coke retarder selected from the group consisting of elemental phosphorous and compounds thereof to retard the formation of coke in high-temperature petroleum treatments.

Also, U.S. Pat. No. 4,024,048, Shell et al., teaches that certain phosphate and phosphite mono and diesters and thioesters in small amounts function as antifoulant additives in overhead vacuum distilled gas oils employed as feedstocks in hydrosulfurizing wherein such feedstocks are subjected to elevated temperatures of from about 200° to 700° F. U.S. Pat. No. 4,024,049, Shell et al., teaches that certain thio -phosphate and -phosphite mono-and di-esters in small amounts function as antifoulant additives in crude oil systems employed as feedstocks in petroleum refining which are subjected to elevated temperatures of from about 100° to 1500° F. Furthermore, U.S. Pat. No. 4,024,050, Shell et al., teaches that certain phosphate and phosphite mono- and di- esters in small amounts function as antifoulant additives in crude oil systems employed as feedstocks in petroleum refining which are subjected to elevated temperatures of from about 100° to 1500° F. U.S. Pat. No. 4,024,051, Shell et al., teaches the use of certain phosphorous acids or their amine salts as antifoulants in petroleum refining processes. U.S. Pat. No. 4,226,700, Broom, discloses a method for inhibiting the formation of foulants on petrochemical equipment which involves adding to the petrochemical, during processing, a composition comprising a thiodipropionate and either a certain dialkyl acid phosphate ester or a certain dialkyl acid phosphite ester. Moreover, U.S. Pat. No. 4,425,223, Miller, discloses that hydrocarbon process equipment is protected against fouling during processing of high sulfur containing hydrocarbon feed stocks by incorporating into the hydrocarbon being processed small amounts of a composition comprised of a certain alkyl ester of a phosphorous acid and a hydrocarbon, surfactant type, sulfonic acid.

U.S. Pat. No. 4,440,625, Go et al., teaches that hydrocarbon process equipment is protected against fouling by incorporating into the hydrocarbon being processed small amounts of a composition comprised of a dialkylhydroxylamine and an organic surfactant. Moreover, U.K. Pat. No. 2,157,670, Nemes et al., discloses a composition containing a hydroxylamine compound; a quinone, a dihydroxylbenzene, or an aminohydroxybenzene compound; and a neutralizing amine which is useful as an oxygen scavenger and corrosion inhibitor in boiler water and other aqueous systems. Additionally, U.S. Pat. No. 4,456,526, Miller et al, teaches that hydrocarbon process equipment is protected against fouling by incorporating into the hydrocarbon being processed small amounts of composition comprised of a dialkylhydroxylamine and a tertiary alkyl-catechol. U.S. Pat. No. 4,509,952, relates to an alkyldimethylamine ranging from $C_4$–$C_{20}$ alkyl which may be added to a distillate fuel as a stabilizer to prevent fuel oil degradation.

However, none of these prior art references disclose the unique and effective mixture of a phosphite compound and a hydroxylamine compound in accordance with the instant invention for inhibiting the degradation, particulate and gum formation of distillate fuel oils prior to and/or during processing. SUMMARY OF THE INVENTION This invention relates to processes for inhibiting the degradation, particulate and gum formation of distillate fuel oils prior to or during processing which comprises adding to the distillate fuel oil an effective inhibiting amount of a mixture of (a) a phosphite compound having the formula

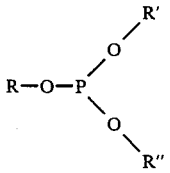

wherein R, R' and R'' are the same or different and are alkyl, aryl, alkaryl or aralkyl groups, and (b) an effective amount of hydroxylamine having the formula

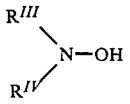

where $R^{III}$ and $R^{IV}$ are the same or different and are hydrogen, alkyl, alkaryl or arlkyl groups, wherein the weight ratio of (a):(b) is from about 1:10 to about 10:1.

More particularly, the processes of this invention relate to inhibiting the degradation, particulate and gum formation of distillate fuel oils prior to or during processing at elevated temperatures. Generally, the total amount of the mixture of (a) and (b) is from about 1.0 parts to about 10,000 parts per million parts of the fuel oil. It is preferred that the weight ratio of (a):(b) is from about 1:10 to about 10:1. This mixture of (a) and (b) provides an unexpectedly higher degree of inhibition of distillate fuel oil degradation than the individual ingredients comprising the mixture. It is therefore possible to produce a more effective inhibiting process than is obtainable by the use of each ingredient alone. Because of the enhanced inhibiting activity of the mixture, the concentrations of each of the ingredients may be lowered and the total amount of (a) and (b) required for an effective inhibiting and antifoulant treatment may be reduced.

Accordingly, it is an object of the present invention to provide processes for inhibiting the degradation, particulate and gum formation of distillate fuel oils prior to or during processing. It is a further object of this invention to inhibit fouling in refinery and petrochemical feedstocks (distillate fuel oils) during processing. These and other objects and advantages of the present invention will be apparent to those skilled in the art upon reference to the following description of the preferred embodiments.

DESCRIPTION OF THE PREFERRED EMBODIMENTS

The present invention pertains to a process for inhibiting the degradation, particulate and gum formation of distillate fuel oil, prior to or during processing, particularly at elevated temperatures, wherein the fuel oil has hydrocarbon components distilling from about 100° F. to about 700° F., which comprises adding to the distillate fuel oil an effective inhibiting amount of a mixture of (a) a phosphite compound having the formula

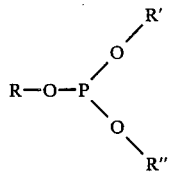

wherein R, R′ and R″ are the same or different and are alkyl, aryl, alkaryl or aralkyl groups, and (b) an effective amount of hydroxylamine having the formula

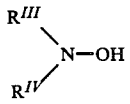

wherein $R^{III}$ and $R^{IV}$ are the same or different and are hydrogen, alkyl, alkaryl or aralkyl groups, wherein the weight ratio of (a):(b) is from about 1:10 to about 10:1. The amounts or concentrations of the two components of this invention can vary depending on, among other things, the tendency of the distillate fuel oil to undergo deterioration or, more specifically, to form particulate matter and/or discolor and subsequently foul during processing. While, from the disclosure of this invention, it would be within the capability of those skilled in the art to find by simple experimentation the optimum amounts or concentrations of (a) and (b) for any particular distillate fuel oil or process, generally the total amount of the mixture of (a) and (b) which is added to the distillate fuel oil is from about 1.0 part to about 10,000 parts per million parts of the distillate fuel oil. Preferably, the mixture of (a) and (b) is added in an amount from about 1.0 part to about 1500 parts per million. It is also preferred that the weight ratio of (a):(b) is from about 1:5 to about 5:1, based on the total combined weight of these two components. Most preferably, the weight ratio of (a):(b) is about 1:1 based on the total combined weight of these two components.

The two components, (a) and (b), can be added to the distillate fuel oil by any conventional method. The two components can be added to the distillate fuel oil as a single mixture containing both compounds or the individual components can be added separately or in any other desired combination. The mixture may be added either as a concentrate or as a solution using a suitable carrier solvent which is compatible with the components and distillate fuel oil. The mixture can also be added at ambient temperature and pressure to stabilize the distillate fuel oil during storage and prior to processing. The mixture may be introduced into the equipment to be protected from fouling just upstream of the point of fouling. The mixture is preferably added to the distillate fuel oil prior to any appreciable deterioration of the fuel oil as this will either eliminate deterioration or effectively reduce the formation of particulate matter and eliminate or reduce subsequent fouling during processing. However, the mixture is also effective even after some deterioration has occurred.

The alkyl, aryl, alkaryl or aralkyl groups of the phosphite compound of this invention may be straight or branch-chain groups. Preferably, the alkyl, aryl, alkaryl and aralkyl groups have 1 to about 20 carbon atoms and, most preferably, these groups have from 2 to about 10 carbon atoms. Examples of suitable phosphite compounds include: triethylphosphite (TEP), triisopropylphosphite, triphenylphosphite, ethylhexyldiphenylphosphite phosphite, triisooctylphosphite (TIOP), heptakis (dipropylene glycol) triphosphite, triisodecylphosphite, tristearylphosphite, trisnonylphenylphosphite, trilaurylphosphite, distearylpentaerythritoldiphosphite, diphenylisodecylphosphite, diphenylisooctylphosphite, poly(dipropylene glycol)phenylphosphite, diisooctyloctylphenylphosphite and diisodecylpentaerythritoldiphosphite. Preferably, the phosphite compound is selected from the group consisting of triethylphosphite, triphenylphosphite, ethylhexyldiphenylphosphite (EHDPP), triisooctylphosphite, and heptakis(dipropylene glycol) triphosphite (PTP).

Examples of suitable hydroxylamines include: hydroxylamine, N-methylhydroxylamine, N,N-dimethylhydroxylamine, N-ethylhydroxylamine, N,N-diethylhydroxylamine (DEHA), N,N-di-n-propylhydroxylamine, N,N-di-n-butylhydroxylamine, N,N-diphenylhydroxylamine, N-benzylhydroxylamine, N,N-dibenzylhydroxylamine, N,N-bis(ethylbenzyl)hydroxylamine, N,N-bis-(m-ethylbenzyl)hydroxylamine, N,N-bis-(p-ethylbenzyl) hydroxylamine, or mixtures thereof. Preferrably, the hydroxylamine is N, N-diethylhydroxylamine.

The distillate fuel oils of this invention are those fuel oils having hydrocarbon components distilling from about 100° F. to about 700° F. Included are straight-run fuel oils, thermally cracked, catalytically cracked, thermally reformed, and catalytically reformed oil stocks, naphthas, lube oils, light and heavy cycle oils, coker naphthas, resids and petrochemical plant feedstocks, and blends thereof which are susceptible to deterioration and fouling. Preferably, the distillate fuel oil is a blend or mixture of fuels having hydrocarbon components distilling from about 250° F. to about 600° F.

The processes of the instant invention effectively inhibit the degradation, particulate and gum formation of the distillate fuel oils prior to or during processing, particularly when such fuel oils are subjected to elevated temperatures of from about 100° F. to about 800° F. The term "particulate formation" is meant to include the formation of soluble solids and sediment.

In order to more clearly illustrate this invention, the data set forth below was developed. The following examples are included as being illustrations of the invention and should not be construed as limiting the scope thereof.

EXAMPLE 1

A six-hour reflux at 121° C. was used to evaluate the effects of the additives. After the reflux period, the samples were filtered through a pre-weighed glass fiber filter using a millipore funnel. The filters were washed with heptane, dried in an oven at 110° C., allowed to cool for 30 minutes, and weighed. The mother liquors were transferred to pre-weighed beakers and evaporated using the ASTM D-2274 procedure. The weights of the gums were obtained and the weights of the gums plus the weights of the sediment on the filters were added together for the total sediment level in mg/100 mL of sample. The data for three different batches of naphtha from a Western refinery are reported in Table I.

TABLE I

Naphtha from a Western Refinery

| Treatment | ppm | Sediment Level mg/100 mL |
|---|---|---|
| None | 0 | 69 (ave. of 6) |
| TEP | 500 | 34.6 |
| DEHA | 500 | 33.2 |
| TEP/DEHA | 250/50 | 24.4 |
| TEP/DEHA | 250/250 | 20.0 |
| TEP/DEHA | 150/150 | 29.4 |
| TEP/DEHA | 100/100 | 22.4 |
| TEP/DEHA | 50/50 | 36.8 |
| TEP/DEHA | 25/25 | 55.0 |
| PTP/DEHA | 50/50 | 31.0 |
| None | 0 | 77 (ave. of 7) |
| PTP/DEHA | 250/250 | 48.0 |
| TEP/DEHA | 250/250 | 46.0 |
| TIOP/DEHA | 250/250 | 32.6 |
| EHDPP/DEHA | 250/250 | 35.4 |
| PTP/DEHA | 500/500 | 64.0 |
| TEP/DEHA | 500/500 | 53.6 |
| EHDPP/DEHA | 500/500 | 49.0 |
| TEP/DEHA | 375/125 | 30.0 |
| TIOP/DEHA | 375/125 | 27.0 |
| EDHPP/DEHA | 375/125 | 51.0 |
| PTP/DEHA | 375/125 | 79.0 |
| TIOP/DEHA | 125/375 | 45.4 |
| TEP/DEHA | 125/375 | 61.0 |
| PTP/DEHA | 125/375 | 92.0 |
| None | 0 | 87 (ave. of 2) |
| TEP | 1000 | 40.0 |
| TEP | 500 | 50.6 |
| TEP | 300 | 66.0 |
| TEP/DEHA | 300/300 | 22.0 |

The results reported in Table I demonstrate the unique and exceptionally effective relationship of the components of this invention since the samples containing both the phosphite compound and hydroxylamine show better overall effectiveness in stabilizing the sediment formation of the naphtha than was obtainable in using each of the components individually.

EXAMPLE 2

A six-hour reflux at 185° C. was used to evaluate the effects of the additives. After the reflux period, the samples were filtered through a pre-weighed glass fiber filter using a millipore funnel. The filters were washed with heptane, dried in an oven at 110° C., allowed to cool for 30 minutes, and weighed. The mother liquors were transferred to pre-weighed beakers and evaporated using the ASTM D-2274 procedure. The weights of the gums were obtained and the weights of the gums plus the weights of the sediment on the filters were added together for the total sediment level in mg/100 mL of sample. The data for a kerosene from a Western refinery are reported in Table II.

TABLE II

Kerosene from a Western Refinery

| Treatment | ppm | Sediment Level mg/100 mL |
|---|---|---|
| None | 0 | 29.4 (ave. of 8) |
| TEP | 150 | 22.4 |
| TEP | 75 | 4.2 |
| DEHA | 75 | 15.0 |
| TEP/DEHA | 75/75 | 20.0 |
| TEP/DEHA | 25/25 | 1.4 |

The results reported in Table II demonstrate the efficacy of the phosphite/hydroxylamine combination of this invention for inhibition of sediment formation.

EXAMPLE 3

A six-hour reflux at 200° C. was used to evaluate the effects of the additives. After the reflux period, the samples were filtered through a pre-weighed glass fiber filter using a millipore funnel. The filters were washed with heptane, dried in an oven at 110° C., allowed to cool for 30 minutes, and weighed. The mother liquors were transferred to pre-weighed beakers and evaporated using the ASTM D-2274 procedure. The weights of hte gums were obtained and the weights of the gums plus the weights of the sediment on the filters were added together for the total sediment level in mg/100 mL of sample. The data for a blend of naphthas from a Midwestern refinery are reported in Table III.

TABLE III

Blend of Naphthas from a Midwestern Refinery

| Treatment | ppm | Sediment Level mg/100 mL |
|---|---|---|
| None | 0 | 98.4 (Ave. of 5) |
| TEP | 200 | 85.6 |
| TEP/DEHA | 152/48 | 42.1 (Ave. of 2) |

The results reported in Table III further demonstrate the substantial efficacy of the phosphate/hydroxylamine combination of this invention for inhibition of sediment formation.

EXAMPLE 4

A six-hour reflux at 200° C. was used to evaluate the effects of the additives. After the reflux period, the samples were filtered through a pre-weighed glass fiber filter using a millipore funnel. The filters were washed with heptane, dried in an oven at 110° C., allowed to cool for 30 minutes, and weighed. The mother liquors were transferred to pre-weighed beakers and evaporated using the ASTM D-2274 procedure. The weights of the gums were obtained and the weights of the gums plus the weights of the sediment on the filters were added together for the total sediment level in mg/100 mL of sample. The data for a straight-run light gas oil (SR-LGO) from a Midwestern refinery are reported in Table IV.

TABLE IV

| SR-LGO Naphtha from a Western Refinery | | | |
|---|---|---|---|
| Treatment | ppm | Sediment Level mg/100 mL | |
| None | 0 | 49.3 | (Ave. of 3) |
| TEP | 120 | 22.6 | |
| TEP/DEHA | 180/120 | 31.4 | |
| TIOP/EBHA | 80/40 | 25.0 | |

EXAMPLE 5

A six-hour reflux at the desired temperature was used to evaluate the effects of the additives. After the reflux period, the samples were filtered through a pre-weighed glass fiber filter using a milliopore funnel. The filters were washed with heptane, dried in an oven at 110° C., allowed to cool for 30 minutes, and weighed. The mother liquors were transferred to pre-weighed beakers and evaporated using the ASTM D-2274 procedure. The weights of the gums were obtained and the weights of the gums plus the weights of the sediment on the filters were added together for the total sediment level in mg/100 mL of sample. The data for different batches of feedstocks are reported in Table V.

TABLE V

| Refinery | Feedstock | Temp. of Test (° C.) | Treatment | ppm | Sediment Level mg/100 mL |
|---|---|---|---|---|---|
| Midwestern | FCCU Naphtha | 80 | None | 0 | 26.6 |
| | | | TEP/DEHA | 228/72 | 17.6 |
| | Coke Still Distillate | 200 | None | 0 | 47.0 |
| | | | TEP/DEHA | 228/72 | 39.0 |
| | "A" HVN | 120 | None | 0 | 22.0 |
| | | | TEP/DEHA | 228/72 | 8.0 |
| | VRU | 60 | None | 0 | 3.8 |
| | | | TEP/DEHA | 228/72 | 5.8 |
| | Coke Still Naphtha | 110 | None | 0 | 87.0 |
| | | | TEP/DEHA | 228/72 | 87.0 |
| | "C" HVN | 123 | None | 0 | 24.4 |
| | | | TEP/DEHA | 228/72 | 5.4 |
| Western | Diesel | 200 | None | 0 | 38.0 |
| | | | TEP/DEHA | 228/72 | 16.0 |
| Midwestern | CCU Feed | 200 | None | 0 | 138.0 |
| | | | TEP | 300 | 53.2 |
| | | | TEP/DEHA | 228/72 | 189.0 |
| Midwestern | CCU Feed | 200 | None | 0 | 70.0 |
| | | | TEP | 300 | 51.0 |
| | | | TEP/DEHA | 228/72 | 72.0 |
| Midwestern | HDS Feed | 200 | None | 0 | 259 |
| | | | TEP/DEHA | 456/144 | 131 |

For completeness, all data obtained during these experiments have been included. Efforts to exclude any value outside acceptable test error limits have not been made. It is believed that, during the course of these experiments, possible errors in preparing samples and in making measurements may have been made which may account for the occasional data point that is not supportive of this art. The following abbreviations are used in Table V; FCCU: Fluid Catalytic Cracker Unit; HVN: Heavy Virgin Naphtha; VRU: Vapor Recovery Unit; CCU: Catalytic Cracking Unit; HDS: Hydrodesulfurization Unit.

In addition, for examples where the test temperature was about 200° C., the extended reflux times (six hours) of these accelerated tests are believed to decompose the phosphorus esters, as noted in the 3rd Edition of the Kirk-Othmer Encyclopedia of Chemical Technology (Vol. 17, p 495), yielding data that would appear unsuccessful. However, in a field unit, the residence time of the phosphorus compounds would be less than five minutes. Therefore, it is believed that the rest of the test data in this invention would indicate that the phosphite/hydroxylamine combination would be efficacious in these particular feedstocks.

While this invention has been described with respect to particular embodiments thereof, it is apparent that numerous other forms and modifications of this invention will be abvious to those skilled in the art. The appended claims and this invention generally should be construed to cover all such obvious forms and modifications which are within the true spirit and scope of the present invention.

What is claimed is:

1. A process for inhibiting the degradation, particulate and gum formation of distillate fuel oils prior to or during processing which comprises adding to the distillate fuel oil an effective inhibiting amount of a mixture of (a) a phosphite compound having the formula

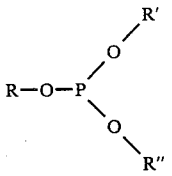

wherein R, R' and R'' are the same or different and are alkyl, aryl, alkaryl or aralkyl groups, and (b) an effective amount of hydroxylamine having the formula

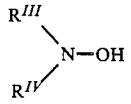

wherein $R^{III}$ and $R^{VI}$ are the same or different and are hydrogen, alkyl, alkaryl or arlkyl groups, wherein the weight ratio of (a):(b) is from about 1:10 to about 10:1.

2. The process of claim 1 wherein said mixture is added in an amount from about 1.0 part to about 10,000 parts per million parts of said fuel oil.

3. The process of claim 1 wherein said mixture is added at elevated temperatures.

4. The process of claim 1 wherein said mixture is added to said fuel oil prior to deterioration of the fuel oil.

5. The process of claim 1 wherein said (a) phosphite compound is selected from the group consisting of triethylphosphite, triphenylphosphite, ethylhexyldiphenylphosphite, triisooctylphosphite, and heptakis(dipropylene glycol)triphosphite.

6. The process of claim 1 or 5 wherein said (b) hydroxylamine is N, N-diethylhydroxylamine.

7. The process of claim 6 wherein the weight ratio of (a):(b) is from about 1:5 to about 5:1.

8. The process of claim 6 wherein the distillate fuel oil is a blended diesel fuel.

9. The process of claim 8 wherein said mixture is added in an amount from about 1.0 part to about 1,500 parts per million parts of said fuel oil.

10. A process for inhibiting the degradation, particulate and gum formation of blended diesel fuel during processing at elevated temperatures which comprises adding to said diesel fuel an effective amount of a mixture of (a) a phosphite compound selected from the group consisting of triethylphosphite, triphenylphosphite, ethylhexyldiphenylphosphite, triisooctylphosphite and heptakis(dipropylene glycol)triphosphite, and (b) N,N-diethylhydroxylamine, wherein the weight ratio of (a):(b) is from about 1:10 to about 10:1.

11. The process of claim 10 wherein said mixture is added in an amount from about 1.0 part to about 10,000 parts per million parts of said diesel fuel.

12. The process of claim 11 wherein said mixture is added at elevated temperatures of from about 100° F. to about 800° F.

13. The process of claim 11 wherein said mixture is added to said fuel oil prior to deterioration of the fuel oil.

14. The process of claim 11 wherein the weight ratio of (a):(b) is from about 1:5 to about 5:1.

15. The process of claim 14 wherein said mixture is added in an amount from about 1.0 part to about 1,500 parts per million parts of said fuel oil.

16. The process of claim 10 wherein said (a) phosphite compound is triethylphosphite.

17. The process of claim 10 wherein said (a) phosphite compound is triphenylphosphite.

18. The process of claim 10 wherein said (a) phosphite compound is ethylhexyldiphenylphosphite.

19. The process of claim 10 wherein said (a) phosphite compound is triisooctylphosphite.

20. The process of claim 10 wherein said (a) phosphite compound is heptakis(dipropylene glycol)triphosphite.

21. The process of claim 16, 17, 18, 19, or 20 wherein the weight ratio of (a):(b) is about 1:1.

* * * * *